US009022675B2

(12) United States Patent
Maekawa et al.

(10) Patent No.: US 9,022,675 B2
(45) Date of Patent: May 5, 2015

(54) IMAGE FORMING APPARATUS HAVING A MEMBER FOR FORMING AN IMAGE

(71) Applicant: Canon Kabushiki Kaisha, Tokyo (JP)

(72) Inventors: Yoshiyuki Maekawa, Susono (JP); Masatoshi Yamashita, Kawasaki (JP); Daisuke Takamura, Fujinomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 13/657,096

(22) Filed: Oct. 22, 2012

(65) Prior Publication Data

US 2013/0108342 A1 May 2, 2013

(30) Foreign Application Priority Data

Oct. 26, 2011 (JP) ..... 2011-235139
Oct. 4, 2012 (JP) ..... 2012-222360

(51) Int. Cl.
*B41J 29/10* (2006.01)
*G03G 21/16* (2006.01)

(52) U.S. Cl.
CPC ..... *G03G 21/1619* (2013.01); *B41J 29/10* (2013.01); *G03G 2215/0132* (2013.01)

(58) Field of Classification Search
CPC ..... B41J 29/08; B41J 29/10; B41J 19/04; E04B 2001/7958; E04B 2001/8281; E04B 2001/8495; G03G 21/1619; B65H 2407/50; B65H 2407/51; B65H 2601/521
USPC ..... 399/91, 107; 400/689–691, 693; 181/198, 201
See application file for complete search history.

(56) References Cited

U.S. PATENT DOCUMENTS 4,636,101 A * 1/1987 Matsukura et al. ..... 400/690
7,835,659 B2 * 11/2010 Moro et al. ..... 399/91
2012/0059099 A1 * 3/2012 Monden et al. ..... 524/161

FOREIGN PATENT DOCUMENTS

JP 06348079 A * 12/1994 ..... G03G 15/00
JP 2000235396 A * 8/2000 ..... G10K 11/16
JP 2009-009016 A 1/2009
JP 2009-031347 A 2/2009

* cited by examiner

*Primary Examiner* — Daniel J Colilla
*Assistant Examiner* — Justin Olamit
(74) *Attorney, Agent, or Firm* — Canon USA Inc IP Division

(57) ABSTRACT

An image forming apparatus includes a drive source configured to drive a member for forming an image on a recording material, a frame of the image forming apparatus including a planar portion on which the drive source is mounted, wherein a plurality of through holes is formed on the entire planar portion of the frame, and a sheet member configured to cover at least a portion of the plurality of through holes.

9 Claims, 15 Drawing Sheets

IMAGE FORMING APPARATUS HAVING A MEMBER FOR FORMING AN IMAGE

BACKGROUND OF THE INVENTION

1. Field of the Invention

The present invention relates to an image forming apparatus such as a copying machine and a printer.

2. Description of the Related Art

An image forming apparatus comprising, as members for forming an image on a recording material, a conveyance unit configured to convey a recording material, an image forming unit configured to form an image on a recording material, and a fixing unit configured to fix the image onto the recording material is known. Some image forming apparatus have such a configuration that a motor as a drive source for driving members for forming an image on a recording material is mounted on a metal plate (plate-like meta member) as a frame of an apparatus body of the image forming apparatus. The drive source becomes a vibrating source which vibrates when the drive source causes a member for forming an image on a recording material to drive upon forming the image. Transmission of the vibration from the drive source to a metal plate causes the metal plate to vibrate, which may generate a noise.

The drive source is provided with various devices to decrease the noise which is generated upon forming an image. Japanese Patent Laid-open Publication No. 2009-009016 discusses a configuration that holes are provided in an area of a metal plate which vibrates most in order to decrease the noise generated from the metal plate on which the drive motor is mounted. Japanese Patent Laid-open Publication No. 2009-031347 discusses a configuration that holes are provided in a frame facing to an exterior cover to prevent a noise which is reflected by the exterior cover to be directed to the frame within the apparatus body from further being reflected by the frame and directing to an exterior member.

However, the above described conventional image forming apparatus has a following problem. In a case where the holes are provided in the area most vibrating in the plate as it is discussed in Japanese Patent Laid-open Publication No. 2009-009016, the noise having a specific frequency can be decreased but the noise having a frequency other than the specific frequency can be hardly decreased. Therefore, in a case where the noise has a wide frequency range, the noise cannot be decreased to a satisfactory level.

In Japanese Patent Laid-open Publication No. 2009-031347, holes are provided in the frame in order to control the noise which is reflected by the exterior cover and directed to the frame so as not to be further reflected by the frame. In other words, the holes are not provided in order to decrease a sound wave itself, which becomes the noise, in the sound waves generated from the frame. Therefore, in a case where holes such as intake ports and exhaust ports are provided in the exterior cover, the noise may come out of the apparatus body and thus positions of the holes provided in the exterior cover are constrained. Depending on a configuration inside the apparatus body, the noise may come out of the apparatus body through an exterior member such that the noise, which is reflected by the exterior cover to be directed to the frame, passes through the holes of the frame and is subsequently reflected by the other member disposed inside the frame within the apparatus body to be directed to the exterior cover again.

SUMMARY OF THE INVENTION

The present invention is directed to an image forming apparatus capable of decreasing a sound wave which becomes a noise out of the sound waves generated from a metal plate on which a vibrating source is mounted.

According to an aspect of the present invention, an image forming apparatus includes a drive source configured to drive a member for forming an image on a recording material, a frame of the image forming apparatus including a planar portion on which the drive source is mounted, wherein a plurality of through holes is formed on the entire planar portion of the frame, and a sheet member configured to cover at least a portion of the plurality of through holes.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The present invention is described below in detail according to exemplary embodiments for carrying out the present invention with reference to drawings attached hereto. Sizes, materials, and shapes of components described in the following exemplary embodiments and relative positioning of the components do not limit the scope of the present invention unless otherwise specifically noted.

Figure 3:
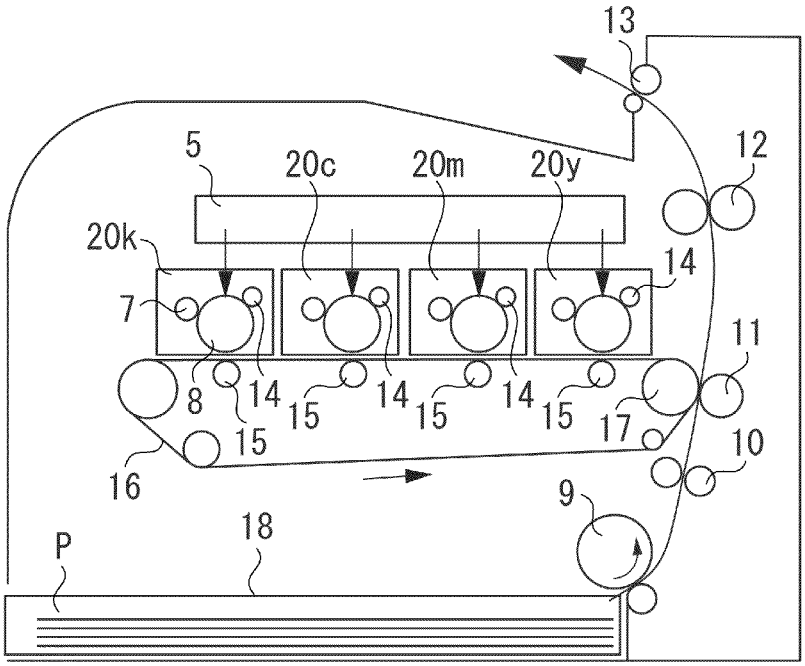
FIG. 3 illustrates a schematic configuration of the image forming apparatus.
Figure 15:
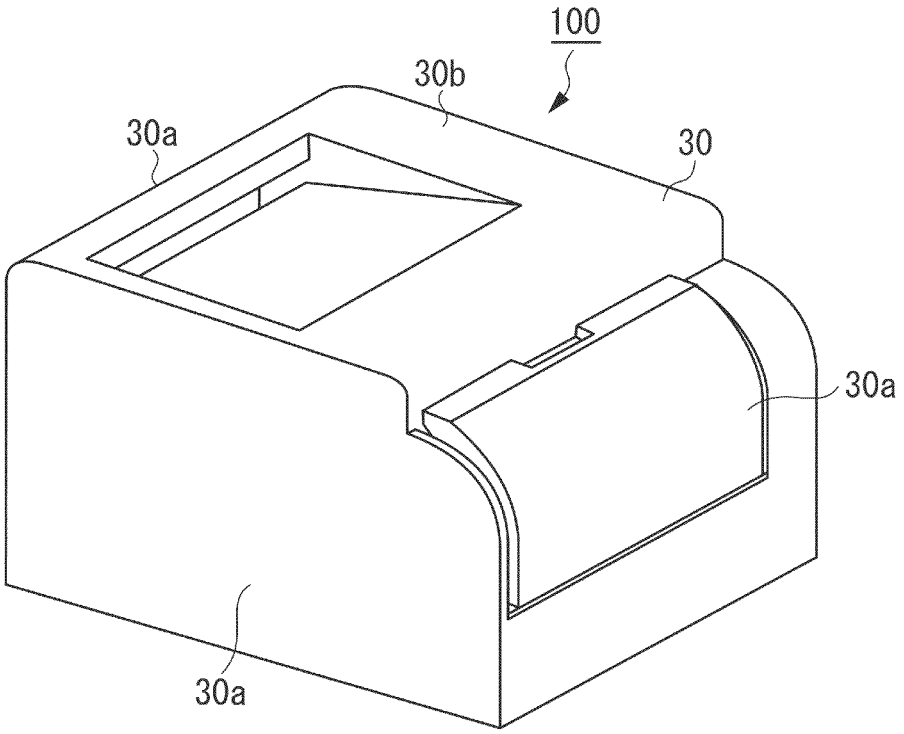
FIG. 15 is an outline view of the image forming apparatus.

A first exemplary embodiment is described below. With reference to FIGS. 3 and 15, a configuration of an image forming apparatus 100 according to the present exemplary embodiment is schematically described below. A full color laser beam printer is exemplified here for the sake of description of the present invention. However, the present invention may be applied to any types of image forming apparatus.

FIG. 15 illustrates an outline of the image forming apparatus 100. As it is illustrated in FIG. 15, the image forming apparatus 100 is covered with an exterior member 30.

FIG. 3 illustrates an inside of the exterior member 30 of the image forming apparatus 100. As illustrated in FIG. 3, the image forming apparatus 100 includes therein four process cartridges 20*y*, 20*m*, 20*c*, and 20*k* corresponding to each of toner colors y, m, c, and k (y denotes yellow, m denotes magenta, c denotes cyan, and k denotes black). The process cartridges 20 have the same configurations each other except for a color of toner to be contained therein, so that symbols y, m, c, and k for indicating the corresponding colors of toners are omitted in the following description.

Each process cartridge 20 is provided with a rotatable photosensitive drum 8 as an image bearing member and further provided with a charging roller 7 and a development roller 14 around the photosensitive rum 8. These components are collectively referred to as an image forming unit. The development roller 14 is provided within a development unit (not illustrated). The development roller 14 carries a toner contained in the development unit and supplies the toner on a surface of the photosensitive drum 8. An exposure unit 5 configured to irradiate laser light onto a surface of each photosensitive drum 8 is provided in the vicinity of the process cartridge 20.

Each photosensitive drum 8 is in contact with an intermediate transfer belt 16. The intermediate transfer belt 16 is stretched by a plurality of rollers so as to be movable in an arrow direction in FIG. 3. A primary transfer roller 15 is provided at a position opposite to the photosensitive drum 8 across the intermediate transfer belt 16.

When an image is formed on a recording material, the surface of the photosensitive drum 8 is uniformly charged in homopolarity with a toner by the corresponding charging roller 7. Subsequently, the surface of the photosensitive drum 8 is scanned and exposed to light based on input image information, thereby forming an electrostatic latent image on the photosensitive drum 8. A toner is supplied to the electrostatic latent image from the development roller 14 to develop the electrostatic latent image as a toner image.

Thus developed toner image is transferred to the intermediate transfer belt 16 by a transferring voltage being applied to a primary transfer roller 15. Transferring of the toner images of an individual color overlapped one another on the intermediate transfer belt 16 enables formation of a toner image having a desired color tone on the intermediate transfer belt 16. The toner left on each photosensitive drum 8 without being transferred to the intermediate transfer belt 16 is removed from the surface of the photosensitive drum 8 by a cleaning member (not illustrated).

The toner image formed on the intermediate transfer belt 16 is conveyed, with the intermediate transfer belt 16 movement, to a transfer nip portion formed of a secondary transfer roller 11 and a counter roller 17. Then, at the transfer nip portion, the toner image is secondary-transferred onto an upcoming recording material P. The recording material P is fed by using a feed roller 9 sheet by sheet from a feed cassette 18 provided in a lower section of an apparatus body of the image forming apparatus 100. The recording material P is timely conveyed to the transfer nip portion by the conveyance unit including a conveyance roller pair 10.

The toner image transferred to the recording material P as described above is heated and pressurized at a fixing device 12 (i.e., fixing unit) disposed in a downstream side of the transfer nip portion in a recording material conveyance direction. As a result thereof, the toner image is fixed on the recording material P. The fixing device 12 comprises a fixing rotor comprising a heater and a pressure rotor which is pressed against the fixing rotor. The fixing device 12 can heat and pressurize the toner image by causing the recording material P to pass through a nip portion (i.e., fixing nip portion) formed of the fixing rotor and the pressure rotor. The recording material P on which the toner image is fixed at the fixing device 12 is discharged to the outside of the apparatus body by a discharge roller pair 13.

A drive motor is described below. As described above, the image forming apparatus 100 is provided with the conveyance unit which conveys a recording material P, the image forming unit which includes the photosensitive drum 8 and the like, and the fixing unit which fixes an image on a recording material P as members for forming an image on a recording material P. The image forming apparatus 100 is further provided with the drive motor (i.e., drive source) which transmits the driving force to the above members for forming the image on the recording material.

The image forming apparatus 100 may be provided with a plurality of drive motors in conformity with the number of units or may be provided with a single drive motor which distributes the driving force to each of the units. The drive motor may transmit the drive force not only to the above described units but also to the other members constituting the image forming apparatus 100.

Figure 1:
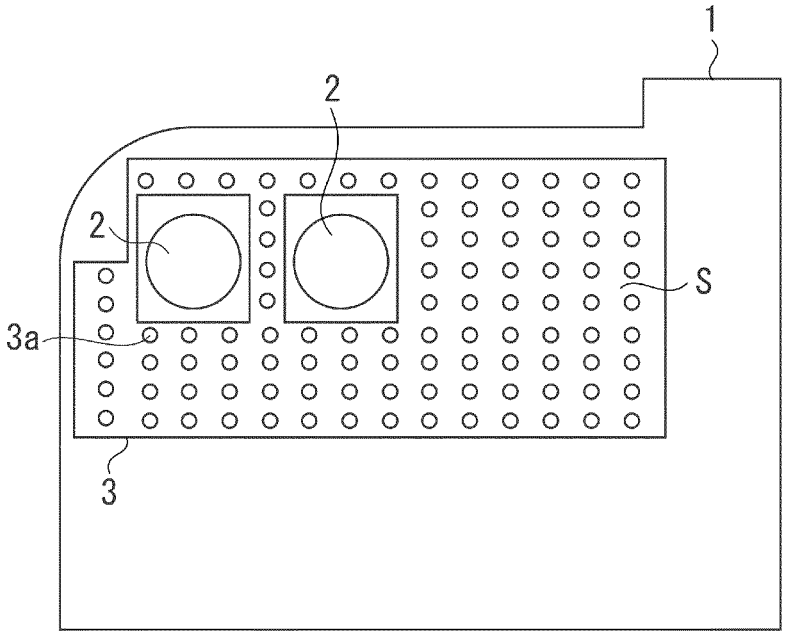
FIG. 1 is a schematic side view of an image forming apparatus.
Figure 2:
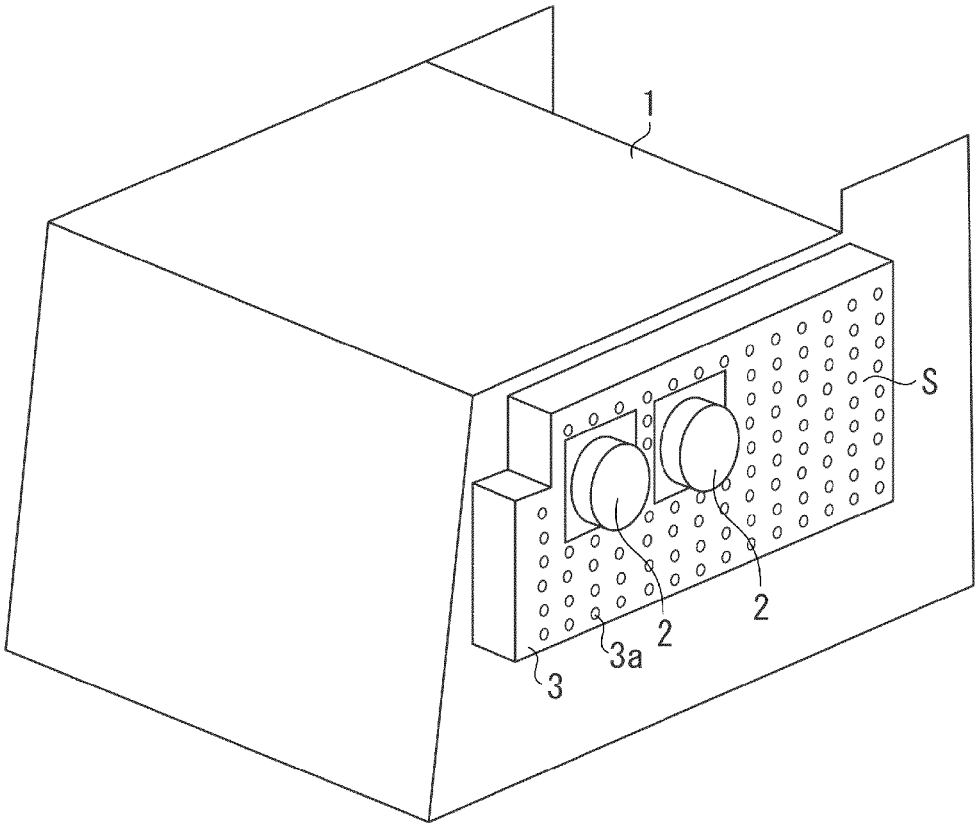
FIG. 2 is a schematic perspective view of the image forming apparatus.

How to mount the drive motor to the image forming apparatus 100 is described below with reference to FIGS. 1 and 2. FIG. 1 is a side view when viewing the image forming apparatus 100 from a direction that the drive motor is mounted on the image forming apparatus 100. FIG. 2 is a perspective view of the image forming apparatus 100 illustrating a drive motor mounting portion. FIGS. 1 and 2 illustrate a state that an exterior cover as an exterior of the image forming apparatus 100 is removed from the image forming apparatus 100.

As illustrated in FIG. 1, in the present exemplary embodiment, the image forming apparatus 100 is provided with two drive motors 2 and the drive motors 2 are screwed on a planar portion S of a metal plate (plate-like metal member) 3 by using screws. As illustrated in FIG. 2, the plate 3 is fixed to a housing 1 of the image forming apparatus 100 and a portion of the metal plate 3 at which the metal plate 3 is not fixed to the image forming apparatus 100 is spaced from a surface of the housing 1. The housing 1 contains driven members such as the above described units and receives the driving force transmitted from the drive motors 2. The housing 1 and the metal plate 3 constitute a frame of the image forming apparatus 1 (hereinafter referred to simply as a "frame"). An exterior member 30 including exterior surfaces 30*a* and an exterior surface 30*b* is mounted on the frame so as to cover the frame. The exterior surfaces 30*a* of the exterior member 30 is made of surfaces approximately along the respective corresponding surfaces (i.e., side surfaces 30*a* and top surface 30*b*) of the frame (see, FIG. 15).

A plurality of through holes 3*a* is provided in a whole surface of a planar portion S of the plate 3 at regular intervals. More specifically, the plurality of through holes 3*a* having a diameter of 2 mm is arranged two-dimensionally at a pitch (i.e., distance between centers of adjacent through holes) of 9 mm. The planar portion S is a planar portion of the plate 3 occupying a relatively large area. A portion which is bent from the planar portion S for the purpose of fixing the metal plate 3 to the other frame portion differs from the planar portion S here. The planar portion S is a part of a side surface (i.e., surface approximately orthogonal to an installation surface) of the frame of the apparatus body, is a surface facing to a side surface 30*a* in a manner approximately in parallel therewith, and is positioned closely inside the side surface 30*a*. Accordingly, the decrease of the noise leaked to the outside of the apparatus via the planar portion S which forms the side surface of the frame of the apparatus body enables a decrease of the noise generated from the entire apparatus.

The planar portion S may be a surface facing to the top surface 30*b* which forms a top surface of the frame. In this case, the planar portion S also can decrease the noise from the entire apparatus. A size of the through holes 3*a*, a pitch (i.e., distance) between the adjacent through holes, an effect produced with the through holes 3*a* will be described below.

Figure 4:
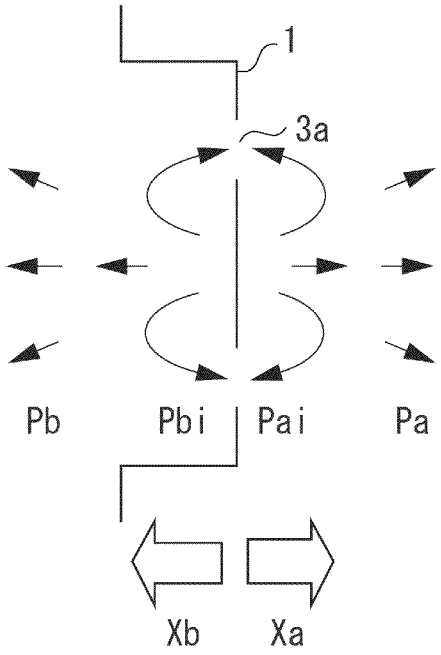
FIG. 4 is a schematic cross sectional view of a metal plate.

A mechanism for decreasing the noise is described below with reference to FIG. 4. FIG. 4 is a schematic cross sectional view of the plate 3 specifically illustrating a cross section of a portion of the metal plate 3 in which the through holes 3*a* are provided.

Since the drive motors 2 are directly mounted on the plate 3 in the above described image forming apparatus 100, the plate 3 is vibrated by the drive motors 2 as a vibration source while the drive motors 2 are driving. The vibration is generated by a vibration of the drive motors 2 themselves and a meshing vibration between a belt for connecting the drive motors 2 with the driven members and a pulley. When the metal plate 3 vibrates, the vibration of the metal plate 3 is transmitted to the air around both side surfaces of the metal plate 3 to generate a noise from the metal plate 3 as a sound radiation surface.

In the present exemplary embodiment, the vibration of the air to be transmitted to each of a front surface of the metal plate 3 (i.e., a surface in a front direction of FIGS. 1 and 2 or a surface in an Xa direction of FIG. 4) and a rear surface (i.e., another surface of the front surface) of the metal plate 3 is cancelled via the through holes 3*a* provided in the metal plate 3, resulting in decreasing the noise. This will be described below in more detail.

As illustrated in FIG. 4, when the metal plate 3 vibrates, a front surface (i.e., in the Xa direction) and a rear surface (i.e., in the Xb direction) of the metal plate 3 become the vibration sources to transmit vibrations thereof to the air therearound. At the time, for example, in a state that the metal plate 3 is deformed in the Xa direction, the air is pushed in the Xa direction at a side of the front surface of the metal plate 3, whereas the air is pulled in a reverse direction of the Xb direction at a side of the rear surface. As a result thereof, an air density of the side of the front surface of the metal plate 3 rises to cause the sound to be denser and an air density of the side of the rear surface of the metal plate 3 drops to sound the noise to be thinner. In other words, a sound wave Pa at the side of the front surface of the metal plate 3 and a sound wave Pb at the side of the rear surface of the metal plate 3 have the same sound pressures and the opposite phases.

In a case where the through holes 3*a* are provided in the metal plate 3, a portion of the sound wave irradiated from each of the front surface and the rear surface of the metal plate 3 comes around to an opposite side of the metal plate 3 via the through holes 3*a* (i.e., Pai and Pbi in FIG. 4). At the time, the sound waves having the opposite phases impact each other in the through holes 3*a* to cause the sound waves Pai and Pbi to cancel each other out. As described above, the sound waves generated from the front surface and the rear surface of the metal plate 3 cancel each other out to decrease the sound wave, which becomes a noise, of the sound waves generated from the metal plate 3.

Since the through holes 3*a* are provided in the entire surface of the metal plate 3, the noise can be decreased more effectively. In other words, since the number of vibrations of the metal plate 3 differs depending on positions on the metal plate 3 and thus frequencies of the sound waves differ depending on the positions on the metal plate 3, a frequency range of the noise may covers a wide range depending on how the plate 3 vibrates. However, since not only the sound wave having the specific frequency but also the sound waves having the different frequencies can be canceled out by providing the through holes 3*a* in the whole surface of the plate 3, the noise can be decreased more effectively.

Figure 5:
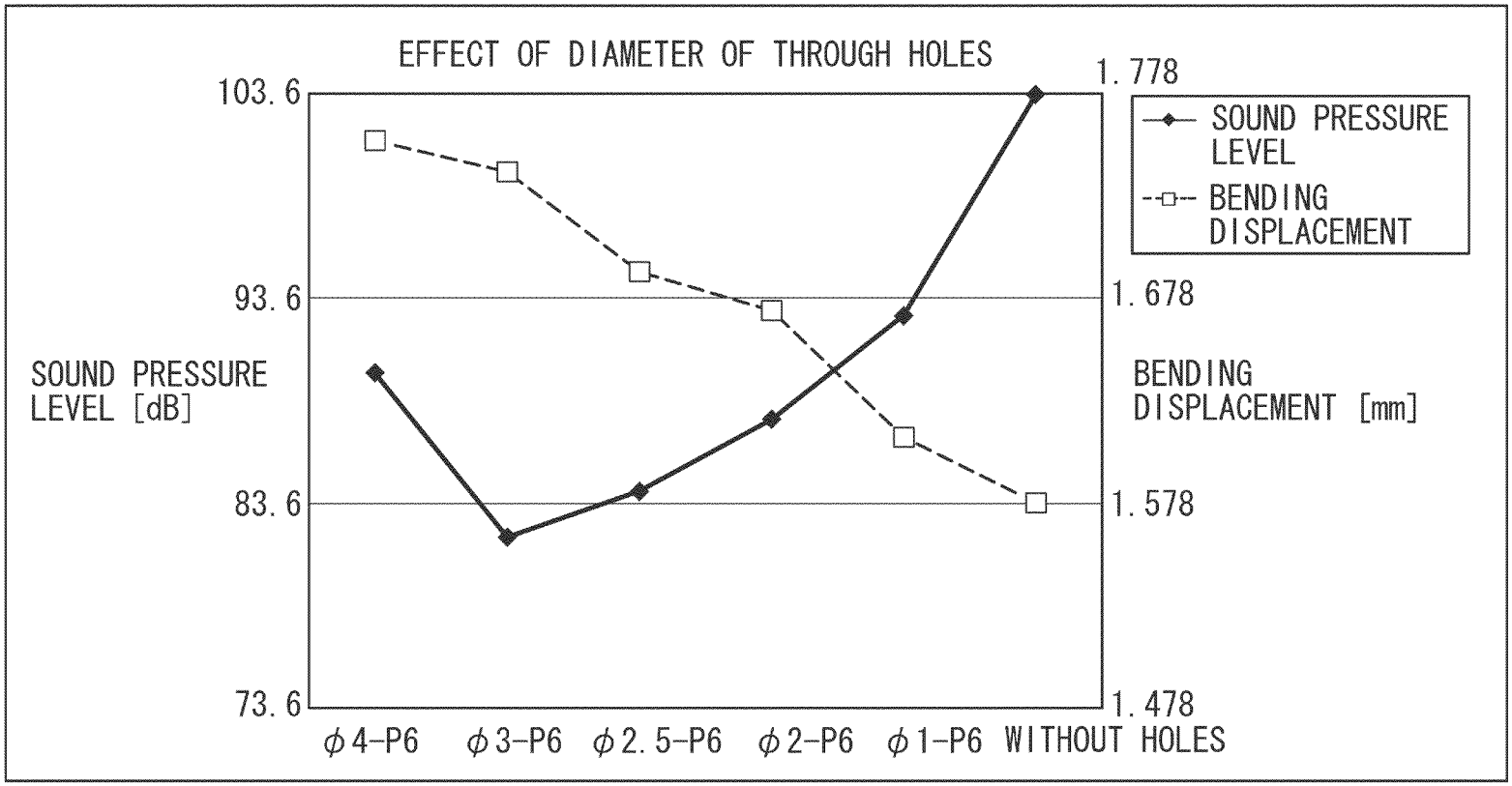
FIG. 5 illustrates a relationship between a sound pressure level and a bending deformation, and a diameter of a through hole.

The diameter of the through holes 3*a* is described below with reference to FIG. 5. FIG. 5 illustrates a simulation result of a sound pressure level (dB) of a noise generated from the metal plate 3 and a bending displacement (mm) of the metal plate 3 when the vibration is applied to the metal plate 3 including the planar portion S having a predetermined area in the metal plate 3, and provided with a plurality of through holes 3*a* arranged perpendicularly intersecting the planar portion S. In FIG. 5, while a pitch between through holes 3*a* is set to 6 mm, a diameter of each through hole is varied to 4 mm, 3 mm, 2.5 mm, 2 mm, 1 mm, and 0 mm (i.e., with through holes). The plurality of through holes 3*a* provided in the metal plate 3 is arranged two-dimensionally at regular intervals. The pitch between the through holes 3*a* is a distance between centers of the adjacent through holes 3*a*.

As described here, the following is found. The sound pressure level of the noise becomes lower as the diameter of the through holes 3*a* is made larger within a range of the diameter of the though holes 3*a* between 0 and 3 mm. When the diameter of the though holes 3*a* becomes more than 3 mm, the sound level of the noise becomes higher as the diameter of the through holes 3*a* is made larger.

On the other hand, it is found that, since rigidity and strength of the plate 3 decrease as the diameter of the through holes is made larger, the bending displacement of the metal plate 3 becomes larger as the diameter of the through holes 3*a* is made larger. The pitch is fixed to 6 mm here for the purpose of a simulation. However, a similar trend can be confirmed when the pitch is fixed to the other values.

In view of the above simulation result, better effect can be produced in decreasing the noise by making the diameter of the through holes 3*a* larger. However, if the diameter of the through holes 3*a* is made too large, such problems arise that the noise becomes larger and that the rigidity and the strength of the plate 3 decreases. The inventors have conducted intensive studies for solving the above problems and found that the rigidity and the strength of the plate 3 can be kept at a satisfactory level if the diameter of the through holes 3*a* is set to a value larger than 1 mm and less than 3 mm and that the sound pressure level of the noise can be decreased to a satisfactory level.

Figure 6:
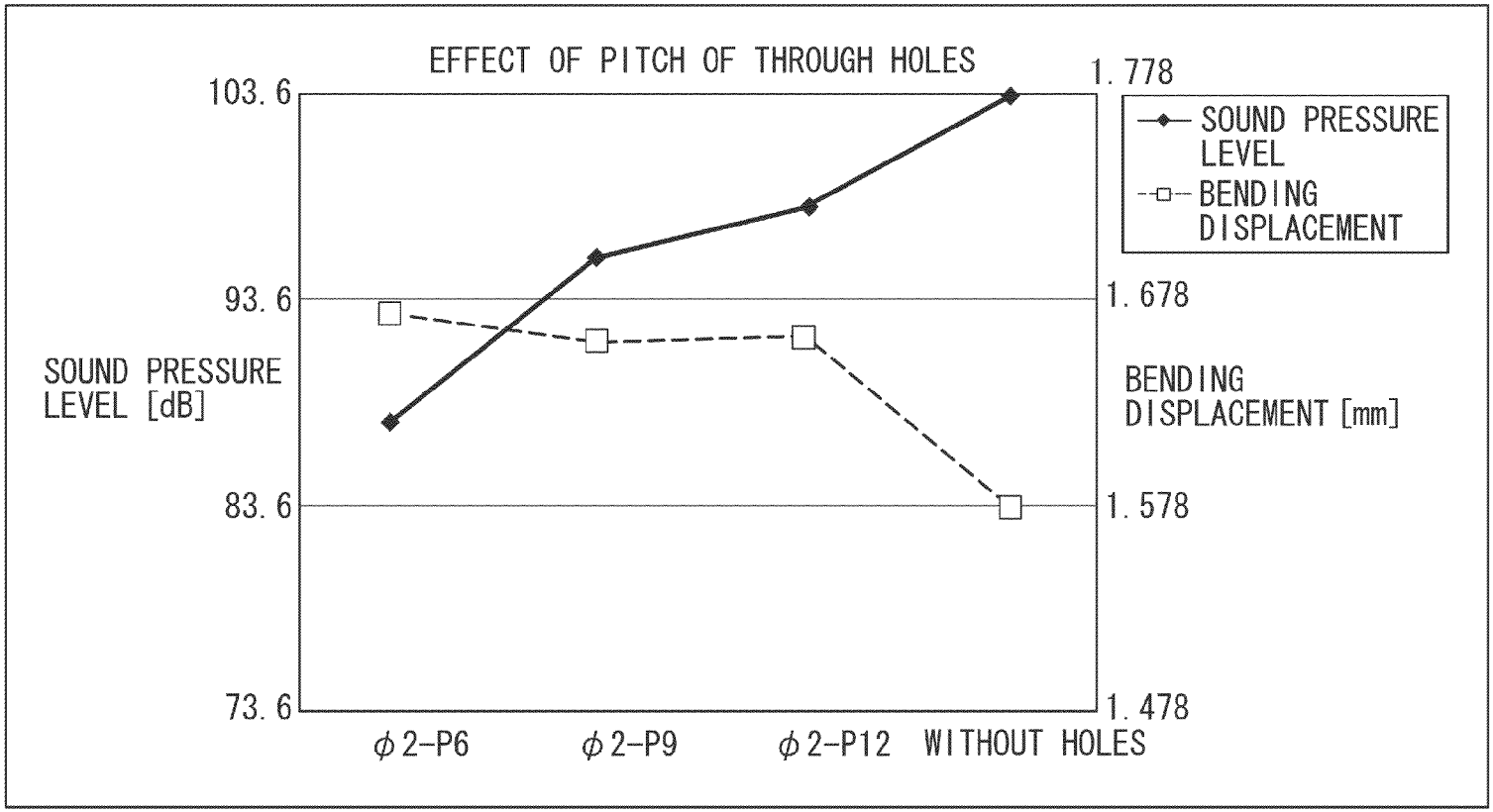
FIG. 6 illustrates a relationship between the sound pressure level and the bending deformation, and a pitch between through holes.

The pitch between the through holes 3*a* is described below with reference to FIG. 6. FIG. 6 illustrates a simulation result of a sound pressure level (dB) of the noise generated from the metal plate 3 and a bending displacement (mm) of the metal plate 3 when a vibration is applied to the metal plate 3 including a planar portion S having a predetermined area in the metal plate 3, and provided with a plurality of through holes 3*a* arranged perpendicularly intersecting the planar portion S. In FIG. 6, while a diameter of the through holes 3*a* is set to 2 mm, a pitch between the adjacent through holes is varied to 6 mm, 9 mm, 12 mm, and 0 mm (i.e., without through holes).

As it is described here, it is found that, since the number of through holes capable of being provided in the metal plate 3 increases as the pitch between the through holes 3*a* is made smaller, the sound pressure level of the noise decreases as the pitch between the through holes 3*a* is made smaller. On the other hand, it is found that, since the rigidity and the strength of the plate 3 decreases as the pitch between the through holes 3*a* is made smaller, the bending displacement of the metal plate 3 becomes larger as the pitch between the through holes 3*a* is made smaller. The diameter of the through holes is fixed to 2 mm here in the simulation. However, a similar trend can be confirmed if the diameter of the through holes 3*a* is fixed to the other values.

In view of the above simulation result, better effect can be produced with a narrower pitch between the through holes 3*a* for decreasing the noise. The inventors have conducted intensive studies for solving the above problems and found that the rigidity and the strength of the metal plate 3 can be kept at a satisfactory level if the pitch between the through holes 3*a* is larger than 6 mm and that the through holes 3*a* can be formed with ease. It is found that the sound pressure level of the noise can be decreased to a satisfactory level if the pitch between the through holes 3*a* is less than 12 mm.

In view of the above described simulation result, in the present exemplary embodiment, if the diameter of the through holes 3*a* is set to a value larger than 1 mm and less than 3 mm and the pitch between the adjacent through holes 3*a* is set to a value larger than 6 mm and less than 12 mm, it is found that the noise can be effectively decreased while the rigidity and the strength of the plate 3 are kept at a satisfactory level.

Since the present exemplary embodiment is configured such that the through holes 3*a* are provided in the plate 3 and the diameter of the through holes 3*a* and the pitch between the through holes 3*a* are set to the values within the above described ranges, the noise generated due to the vibration of the metal plate 3 can be decreased with a simple configuration. The rigidity and the strength of the metal plate 3 may decrease if the through holes 3*a* are provided in the metal plate 3. However, the rigidity and the strength of the plate 3 can be kept at the satisfactory level by setting the diameter of the through holes 3*a* and the pitch between the through holes 3*a* to the values within the above described ranges.

The through holes 3*a* are provided in the entire metal plate 3. Accordingly, even in a case where the frequency range of the noise spreads over a wide range, the noise can be decreased to a satisfactory level. This is described below in detail. In order to cancel out the sound wave having a certain frequency generated on the front surface and the rear surface of the metal plate 3 in the through holes 3*a*, a difference between a distance from a generating point (i.e., vibrating source) at which the sound wave is generated on the metal plate 3 at a side of the front surface of the metal plate 3 to the through holes 3*a* and a distance from a generating point (i.e., vibrating source) at which the sound wave is generated on the metal plate 3 at a side of the rear surface of the metal plate 3 to the through holes 3*a* needs to be an integral multiple of a wavelength of the sound wave. If the difference between the distances is the integral multiple of the wavelength, a phase of each undulation is, as described above, opposite to each other, so that the sound waves are canceled out in the through holes 3*a*.

Typically, the following relationship is established between the number of vibrations f, a wavelength λ, and a speed c (sonic velocity, here) of the undulation. Namely, $f=c/\lambda$. Assuming that the speed c is a constant value, the wavelength λ becomes different when the number of vibrations f is different. In other words, the noise includes the sound waves having the different wavelengths λ. Therefore, the distance from the generating point (i.e., vibrating source) of the sound wave to the through holes 3*a* can be set to various values by providing the through holes 3*a* in the entire plate 3 as described in the present exemplary embodiment. As a result thereof, the sound waves having the different frequencies (or wavelengths) can be canceled out by the respective through holes 3*a*.

Figure 7:
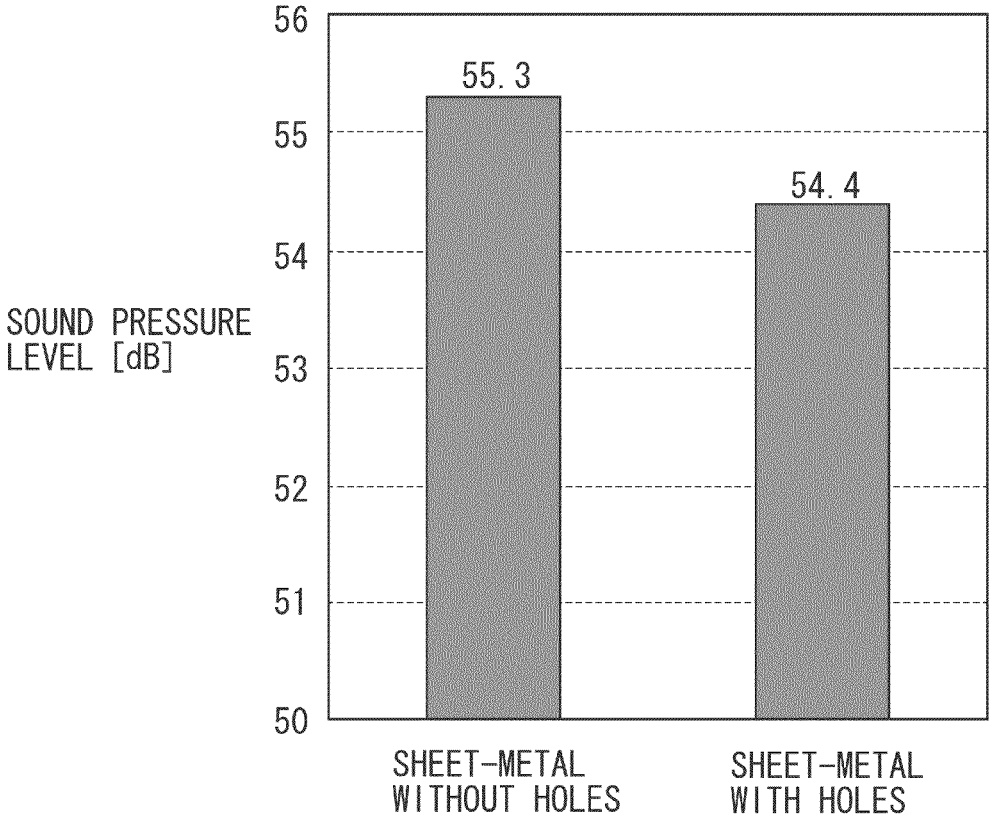
FIG. 7 illustrates an overall value of the sound pressure level of a noise.

Accordingly, even in a case where the frequency range of the noise covers a wide range, the noise can be decreased to a satisfactory level. FIG. 7 illustrates a measurement result of amplitude (dB) of an overall value (i.e., the sum of noises of the respective frequencies) of the sound pressure level of the noises. Tests are performed here by using the image forming apparatus 100 including a metal plate without hole type in which the through holes 3*a* are not provided in the metal plate 3 and image forming apparatus 100 including a metal plate with hole type metal plate according to the present exemplary embodiment in which the through holes 3*a* are provided in the entire metal plate 3, through holes 3*a* having a diameter of 2 mm and being arranged at a pitch of 9 mm. It is found that, with the through holes 3*a* provided in the whole surface of the plate 3, the sound pressure level of the noise can be decreased.

In the present exemplary embodiment, the strength of the plate 3 can be kept with ease by arranging the through holes 3*a* two-dimensionally at regular intervals even when a lot of through holes 3*a* are provided in the metal plate 3.

Figure 14:
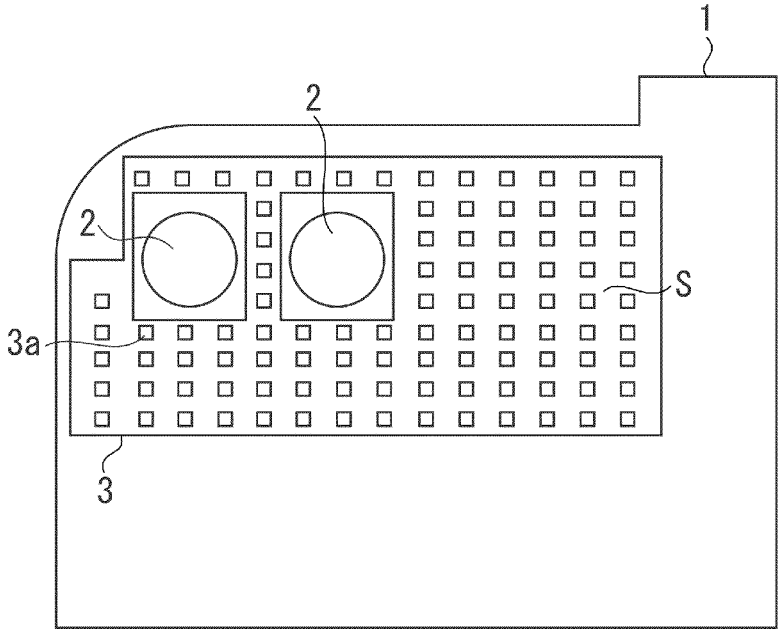
FIG. 14 is a schematic side view of an image forming apparatus according to another exemplary embodiment.

In the present exemplary embodiment, the through holes 3*a* are formed into a circular shape but may be formed into any other shapes. An example of the shape of the through holes 3*a* may include a square shape as illustrated in FIG. 14. Since the sound waves generated from the sheet-plate 3 can be canceled out also by providing such square shaped through holes 3*a* in the entire metal plate 3, a sound wave, which becomes a noise, out of the sound waves generated from the metal plate 3 can be decreased to a satisfactory level.

The present exemplary embodiment is configured such that the sound waves generated from the front surface and the rear surface of the plate 3 are canceled each other out by providing holes having a predetermined diameter and arranged at a predetermined pitch in the metal plate 3. Therefore, a sound wave, which becomes a noise, out of the sound waves generated from the metal plate 3 can be decreased, the metal plate 3 being provided with the vibrating source such as the drive motors 2 mounted thereon. Accordingly, the noise can be decreased disregarding presence or absence of the through holes in the exterior cover.

A second exemplary embodiment will be described below. A configuration in which the noise can be decreased more is described below. The same reference numbers and/or symbols are provided to configurations similar to those of the first exemplary embodiment and thus descriptions thereof are omitted here.

Figure 8:
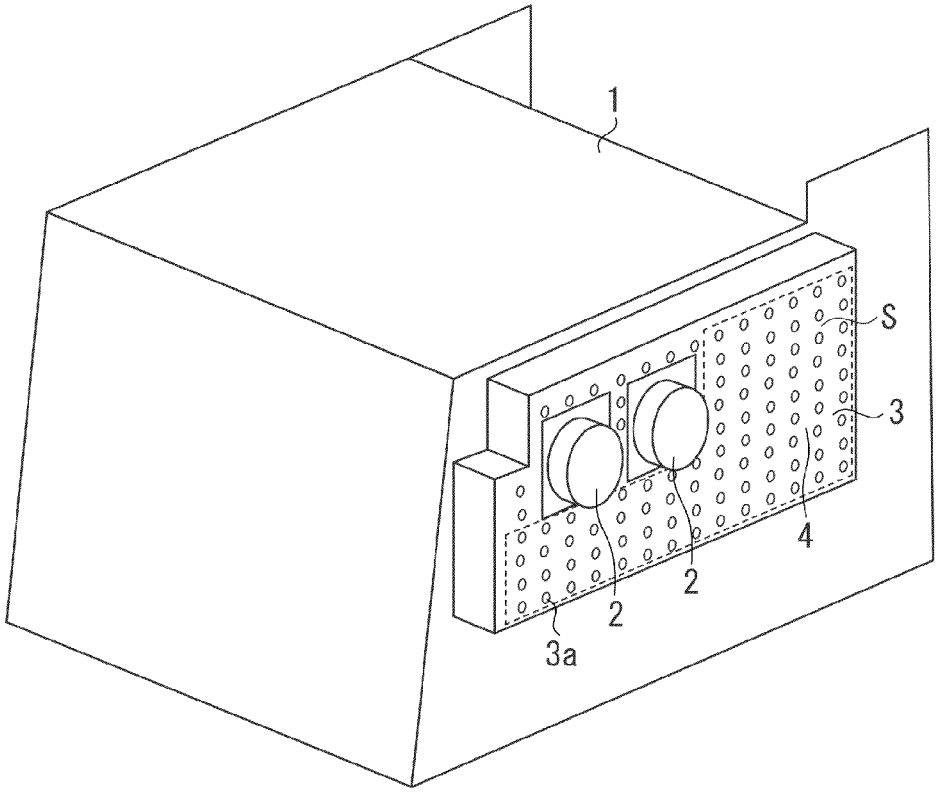
FIG. 8 is a schematic perspective view of the image forming apparatus.

FIG. 8 is a perspective view of the image forming apparatus 100 illustrating a mounting portion of the drive motors 2. FIG. 8 illustrates a state that the exterior cover as the exterior of the image forming apparatus 100 is removed from the image forming apparatus 100.

In the present exemplary embodiment, similar to the first exemplary embodiment, the plurality of through holes 3*a* having a diameter of 2 mm are two-dimensionally arranged at regular intervals, i.e., at a pitch of 9 mm, in the sheet-plate 3 and a resin-made sheet member 4 is provided so as to at least partially cover the plurality of through holes 3*a*. FIG. 8 illustrates such that the through holes 3*a* are viewable through the sheet member 4 (i.e., sheet member 4 is illustrated by a broken line) for easy understanding. The sheet member 4 is hooked on the plate 3 such that a space between the plate 3 and the sheet member 4 becomes 0.5 mm. Then, the sheet member 4 is secured onto the plate 3. As the resin-made sheet member 4, the Eco-sheet (trademark) Polycarbonate (PC) manufactured by SUMITOMO BAKELITE CO., LTD., is employed here. The Eco-sheet PC has a thickness of 0.2 mm here.

Figure 9:
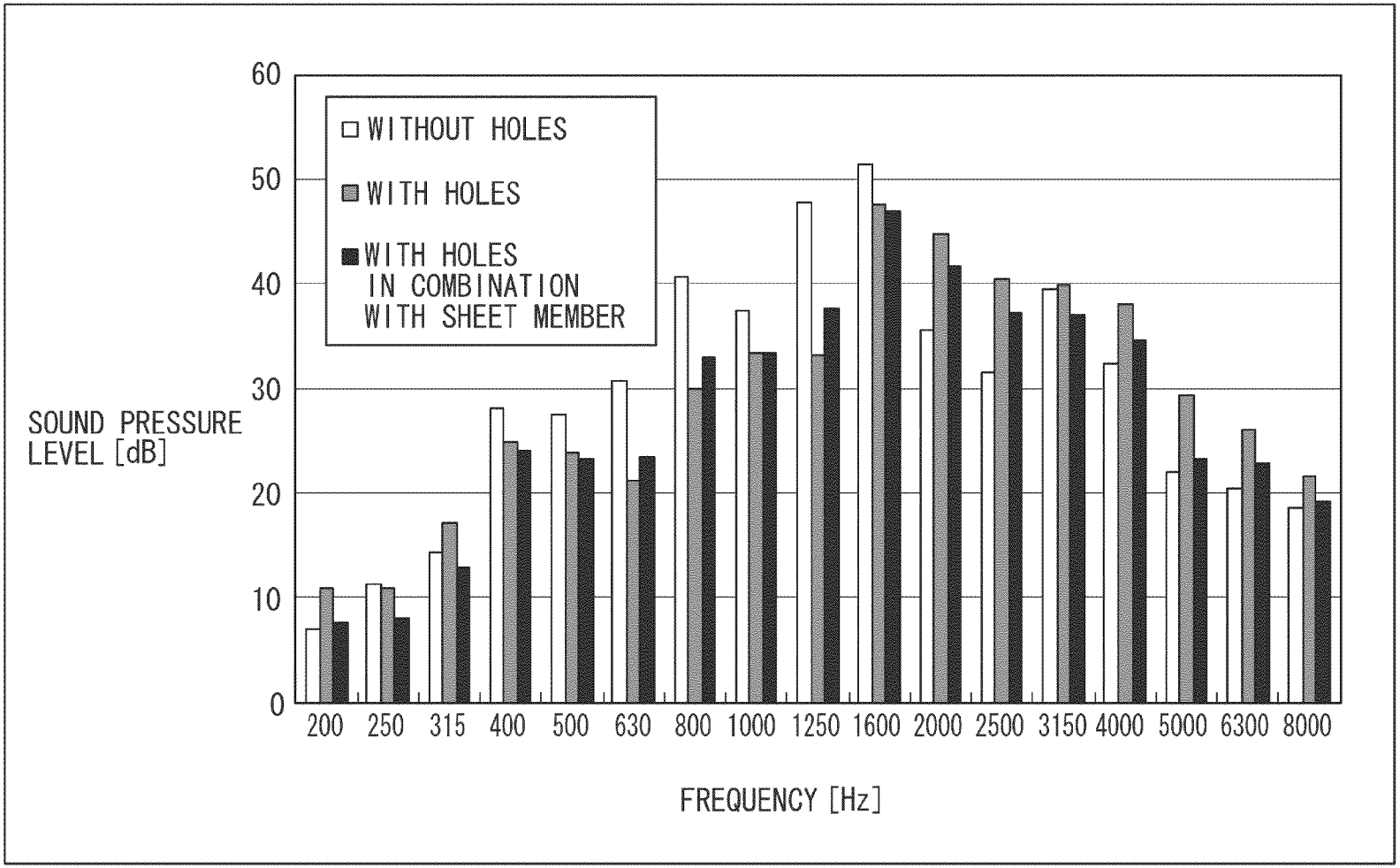
FIG. 9 illustrates a level of the sound pressure level in each frequency of the noise.
Figure 10:
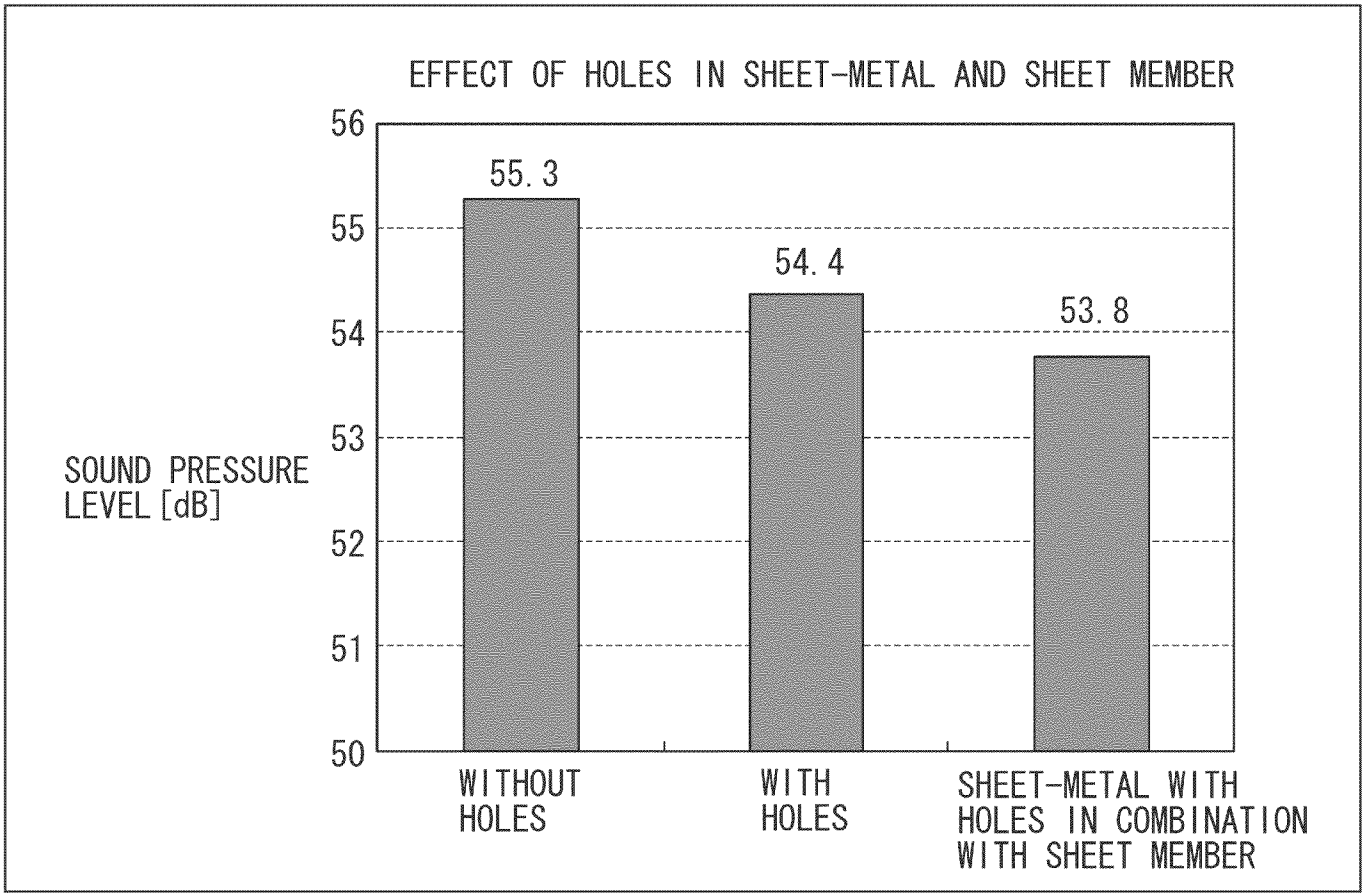
FIG. 10 illustrates the overall value of the sound pressure level of the noise.

An effect of the above described configuration is described below. Measurement values of the image forming apparatus 100 including the metal plate 3 with the holes in combination with the sheet member according to the present exemplary embodiment illustrated in the below described FIGS. 9 and 10 are obtained with the above described configuration (i.e., a configuration in which the through holes 3*a* having a diameter of 2 mm are provided at a pitch of 9 mm in the whole surface of the metal plate 3, and the Eco-sheet(trademark) PC manufactured by SUMITOMO BAKELITE CO., LTD., having a thickness of 0.2 mm, is attached to the plate 3 with a space of 0.5 mm between the metal plate 3 and the Eco-sheet(trademark) PC. In a case of the image forming apparatus 100 including a metal plate with holes type in which the entire metal plate 3 is provided with the through holes 3*a*, the measurement value is obtained with the image forming apparatus 100 including the metal plate 3 provided with the through holes 3*a*, having a diameter of 2 mm and being arranged in the entire metal plate 3 at a pitch of 9 mm, according to the first exemplary embodiment.

FIG. 9 illustrates a measurement result of amplitude (dB) of the sound pressure level of the respective frequencies contained in the noise. Tests are performed by using an image forming apparatus 100 of the without holes type in which the metal plate 3 is provided with no through hole 3*a*, an image forming apparatus 100 of the with holes type in which the metal plate 3 is provided with through holes 3*a* in the entire sheet-plate 3 according to the first exemplary embodiment, and an image forming apparatus 100 of a type in which the metal plate 3 is provided with the through holes 3*a* mostly covered with the sheet member 4 according to the above described present exemplary embodiment.

The with holes type according to the first exemplary embodiment is compared with the conventional without holes type below. As described above in the description of the first exemplary embodiment, in the case of the with holes type, the sound waves generated from the front surface and the rear surface of the plate 3 are canceled each other out, so that the noise is more decreased in comparison with the conventional without holes type. However, the following is found. The canceling effect can be produced in the sound waves having a frequency equal to or less than 1600 Hz. On the other hand, the noise having a frequency equal to or more than 2000 Hz becomes larger in comparison with the noise in the case of the without holes type. The reason why the above phenomenon occurs is described below. Namely, the sound wave hardly comes around as the frequency becomes higher. Accordingly, the sound wave radiated from the rear surface of the metal plate 3 becomes hardly coming around to a side of the front surface to cancel out the sound wave radiated from the front surface of the metal plate 3.

Further, the sound wave having a high frequency radiated from the rear surface reflects within the apparatus, so that the sound wave passes through the through holes 3*a* in the metal plate 3 to leak to the outside of the apparatus. However, since the canceling effect for the noise having the frequency equal to or less than 1600 Hz is larger than the leakage noise having the frequency equal to or more than 2000 Hz, as illustrated in FIG. 7, the overall value (i.e., the sum of noises of the respective frequencies) of the sound pressure level of the noises decreases. As a result thereof, the noise can be decreased.

The image forming apparatus 100 of the with holes type is compared with the image forming apparatus 100 of the with holes in combination with the sheet member type in which the sheet member 4 is attached to the metal plate 3 according to the above descried present exemplary embodiment below. It is found that, by attaching the sheet member 4 to the plate 3 in a manner as described in FIG. 8, the sound pressure level of the noise having a relatively high frequency, i.e., the noise having a frequency equal to or more than 2000 Hz, can be decreased.

The reason thereof is described below. The sound wave having a high frequency which is radiated to the rear surface of the metal plate 3 and fails to come around to the side of the front surface is reflected within the apparatus and leaks to the outside of the apparatus body via the through holes 3*a* provided in the entire metal plate 3. A transmission loss (TL) can be calculated by an equation (1). Where ω indicates a frequency, m indicates a mass per unit area of the metal plate 3, and z indicates an acoustic impedance density. As it is found from the equation (1), the TL becomes larger as the frequency ω becomes higher. Covering of the through holes 3*a* with a sound insulation member can produce such an effect that the leakage of the sound wave having a relatively high frequency to the outside of the apparatus body can be decreased.

[Equation 1]

$$TL = 20 \cdot \log\left(\frac{\omega m}{2z}\right) \tag{1}$$

The overall value (i.e., the sum of noises of the respective frequencies) of the sound pressure level of the noises is described below. FIG. 10 illustrates a measurement result of the overall value of the sound pressure level of the noises. Tests are performed by using the image forming apparatus 100 of the without holes type in which the sheet-plate 3 is provided with no holes 3*a*, the image forming apparatus 100 of the with holes type in which the metal plate 3 is provided with the through holes 3*a* in the entire plate 3 according to the first exemplary embodiment, and the image forming apparatus 100 of a type in which the metal plate 3 is provided with the through holes 3*a* in combination with the sheet member 4 covering almost the whole surface of the plate 3 according to the above described present exemplary embodiment. In the image forming apparatus 100 of the type including the metal plate 3 with the through holes 3*a* in combination with the sheet member 4, the metal plate 3 is provided with the through holes 3*a* having the above described diameter of 2 mm and arranged at a pitch of 9 mm in the entire metal plate 3 and the sheet member 4 (i.e., Eco-sheet (trademark) PC manufactured by SUMITOMO BAKELITE CO., LTD.) having a thickness of 2 mm attached to the metal plate 3 with a space of 0.5 mm.

It is found that the image forming apparatus 100 of the type including the metal plate with holes in combination with the sheet member in which the sheet member 4 is attached to the metal plate 3 according to the above described present exemplary embodiment has a sound pressure level smaller by 0.6 dB than the image forming apparatus 100 of the metal plate with holes type according to the first exemplary embodiment.

Figure 11:
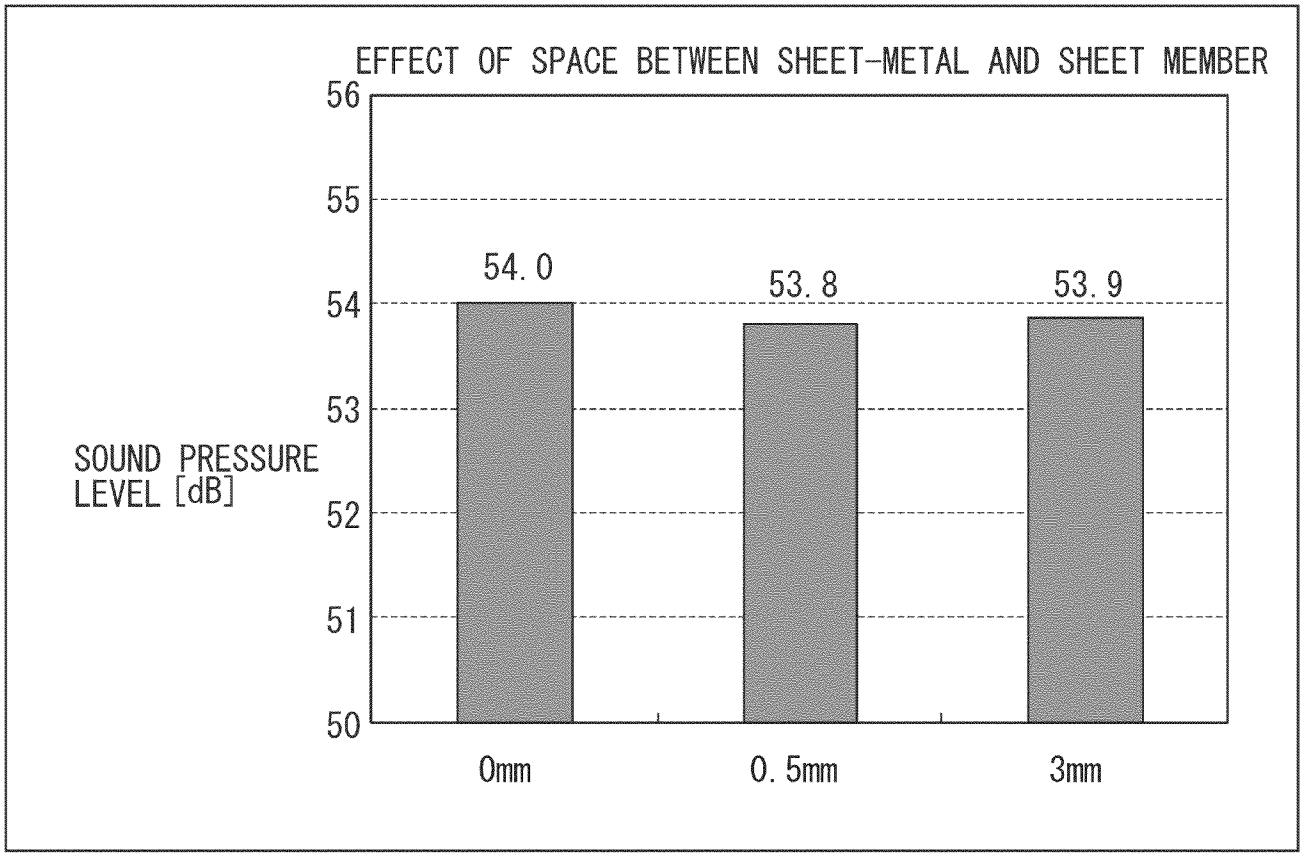
FIG. 11 illustrates the overall value of the sound pressure level of the noise.

The space between the plate 3 and the sheet member 4 is described below. FIG. 11 is a measurement result of the overall value of the sound pressure level of the noises when the space between the plate 3 and the sheet member 4 is varied. The measurement was performed by using the image forming apparatus 100 including the metal plate 3, provided with the through holes 3*a* having a diameter of 2 mm so as to be arranged at a pitch of 9 mm, in combination with the sheet member 4 (i.e., Eco-sheet (trademark) PC manufactured by SUMITOMO BAKELITE CO., LTD.) having a thickness of 2 mm attached to the plate 3. In the measurement result, it is found that the sound pressure level in the above cases is smaller than the sound pressure level (i.e., 54.4 [dB]) of the case where the metal plate with holes provided with no sheet member 4 attached to the plate 3 is used and the sound pressure level (i.e., 55.3 [dB]) of the case where the metal plate without holes is used as illustrated in FIG. 10.

The sound pressure level is more controlled in the cases where the space is 0.5 mm and the space is 3 mm than the case where the space is 0 mm. This is because an effect of coming around of the sound wave having a relatively low frequency (i.e., frequency equal to or less than 1600 Hz) via the through holes 3*a* can be produced easier in a case where there is a space to some extent between the plate 3 and the sheet member 4. To the contrary, if the space is too wide, the sound wave having a relatively high frequency (i.e., frequency equal to or more than 2000 Hz) leaks via the space to the outside. The inventors have conducted intensive studies in order to solve the above problem and found that a desirable space between the plate 3 and the sheet member 4 is larger than 0 mm and less than 5 mm.

Figure 12:
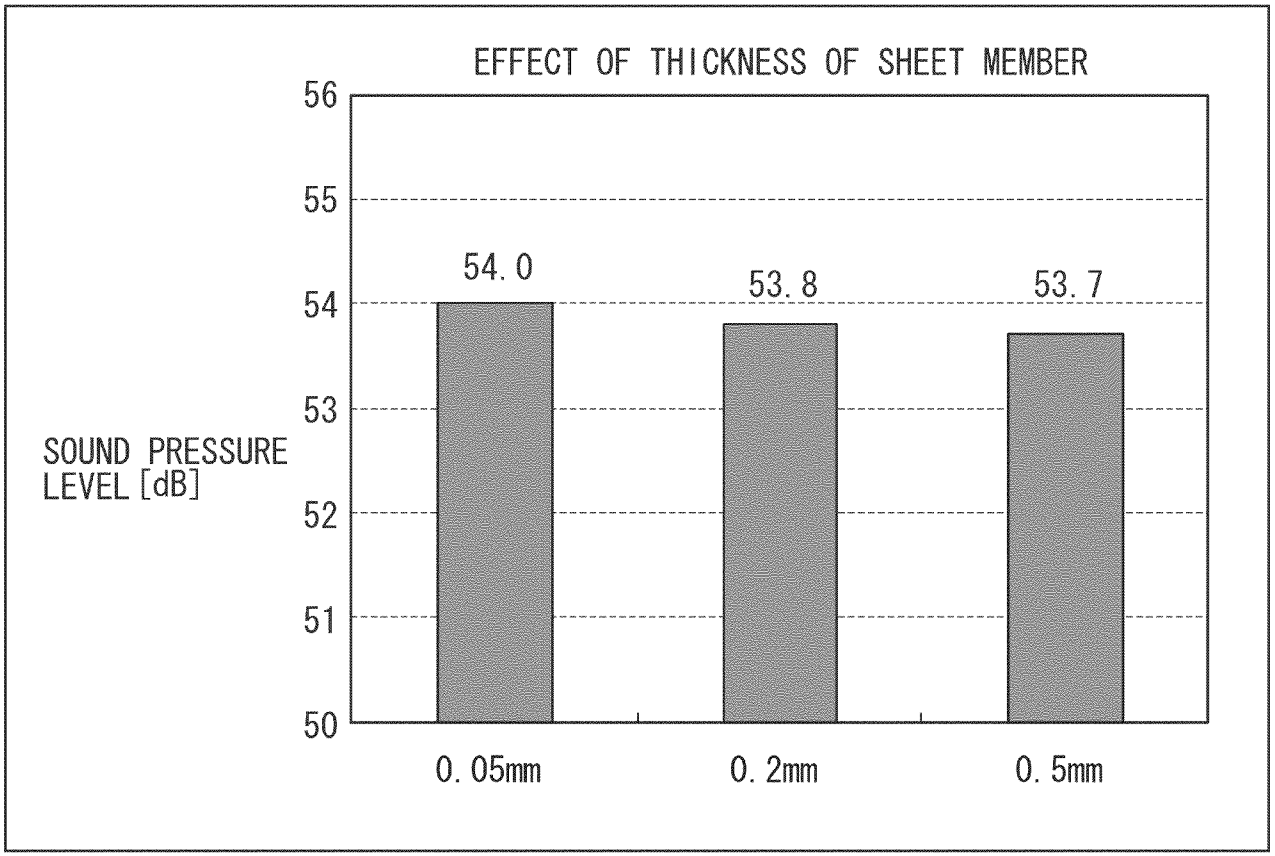
FIG. 12 illustrates the overall value of the sound pressure level of the noise.

FIG. 12 is a measurement result of the overall value of the sound pressure level of the noises when a thickness of the sheet member 4 is varied. The tests are performed by using the image forming apparatus 100 including the metal plate 3 with the through holes 3*a*, having a diameter of 2 mm and arranged at a pitch of 9 mm, in the entire plate 3 in combination with the sheet member 4 (i.e., Eco-sheet (trademark) PC manufactured by SUMITOMO BAKELITE CO., LTD.) having a different thickness attached to the metal plate 3 in each case, the sheet member 4 being spaced from the metal plate 3 by 0.5 mm. It is found that the sound pressure levels of the above described cases are smaller than the case of the metal plate with holes provided with no sheet member 4 attached to the metal plate 3 (i.e., 55.3 [dB]) and the case of the metal plate without holes (i.e., 55.3 [dB]) as described in FIG. 10.

Figure 13:
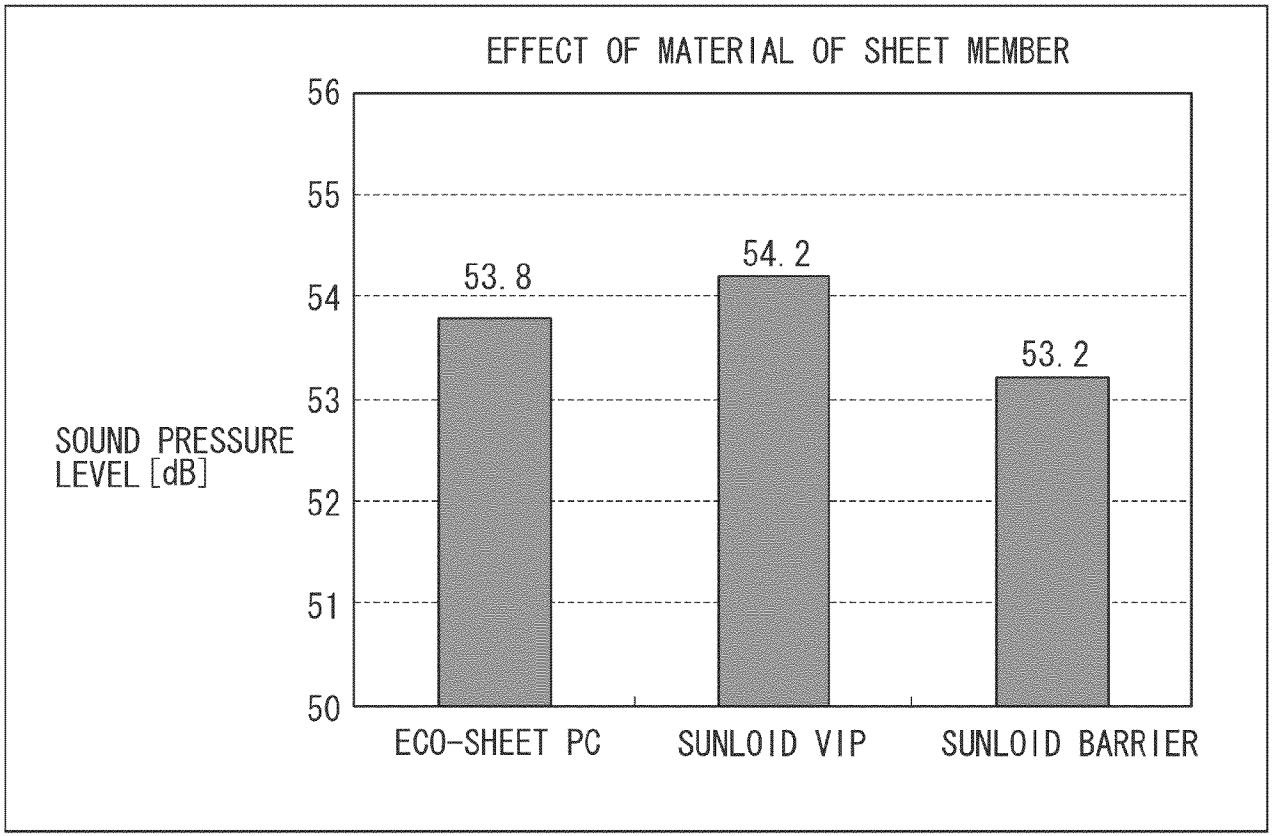
FIG. 13 illustrates the overall value of the sound pressure level of the noise.

FIG. 13 illustrates a measurement result of the overall value of the sound pressure level of the noises when a material of the sheet member 4 is varied. Tests are performed by using the image forming apparatus 100 including the metal plate 3 provided with the through holes 3*a*, having a diameter of 2 mm and arranged at a pitch of 9 mm, in the entire plate 3, in combination with the sheet member 4 having a thickness of 2 mm attached to the plate 3 so as to be spaced by 0.5 mm. The sheet member 4 is any one of the Eco-sheet(trademark) PC manufactured by SUMITOMO BAKELITE CO., LTD., a SUNLOID VIP (trademark) manufactured by SUMITOMO BAKELITE CO., LTD., or a SUNLOID BARRIER (trademark) manufactured by SUMITOMO BAKELITE CO., LTD. It is found that the sound pressure level obtained from any one of the sheet members is smaller than the sound pressure level (i.e., 54.4 [dB]) of the metal plate with holes provided with no sheet member 4 and the sound pressure level (i.e., 55.3 [dB]) of the metal plate without holes as illustrated in FIG. 10.

As described above, in the present exemplary embodiment, as for the sound wave having a relatively low frequency, i.e., frequency equal to or less than 1600 Hz, the sound waves coming around are canceled each other out owing to the effect of the through holes 3*a*. As a result thereof, a phenomenon that the sound wave generated from the plate 3 becomes the noise is decreased. As for the sound wave having a relatively high frequency, i.e., frequency equal to or more than 2000 Hz, by closing the through holes 3*a* by using the sheet member 4 as the sound insulation member, leakage of the sound wave to the outside of the apparatus body can be decreased. Accordingly, the overall value of the sound pressure level of the noises can be further decreased. In the present exemplary embodiment, as illustrated in FIG. 8, the sheet member 4 is provided so as to cover almost all the plurality of through holes 3*a* provided the entire planar portion S of the plate 3. However, the sheet member 4 may cover at least a portion of the plurality of through holes 3*a*. According to the present exemplary embodiment, the plurality of through holes 3*a* provided in the metal plate 3 to which the sheet member 4 is attached has a diameter larger than 1 mm and less than 3 mm and is arranged at a pitch larger than 6 mm and less than 12 mm in a similar manner as in the case of the first exemplary embodiment.

As described above, according to the present exemplary embodiment, the overall value of the sound pressure level of the noises can be further decreased while the sound wave, which becomes a noise, out of the sound waves generated from the metal plate 3, to which the vibrating source such as the drive motors is mounted, is decreased. As a result thereof, the noise can be decreased irrespective of the presence or the absence of the through holes 3*a* in the surface of the exterior cover.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2011-235139 filed Oct. 26, 2011 and No. 2012-222360 filed Oct. 4, 2012, which are hereby incorporated by reference herein in their entirety.

What is claimed is:

1. An image forming apparatus, comprising:

a member configured to form an image on a recording material;

a drive source configured to drive the member;

a frame including a planar portion on which the drive source is mounted, wherein a plurality of through holes is formed on the planar portion of the frame;

an exterior member configured to cover the frame; and a sheet member disposed between the exterior member and the planar portion of the frame and configured to cover at least one of the plurality of through holes, wherein the planar portion and the sheet member form a mechanism for decreasing noise in the image forming apparatus.

2. The image forming apparatus according to claim 1, wherein a space between the planar portion of the frame and the sheet member is larger than 0 mm and less than 5 mm. surface of the planar portion of the frame.

3. The image forming apparatus according to claim 1, wherein the sheet member is made of a resin.

4. The image forming apparatus according to claim 1, wherein each of the plurality of through holes has a diameter larger than 1 mm and less than 3 mm and the plurality of through holes is arranged such that a distance between centers of adjacent through holes in the plurality of through holes is larger than 6 mm and less than 12 mm.

5. The image forming apparatus according to claim 4, wherein through holes of the plurality of through holes are arranged at regular intervals in the surface of the planar portion of the frame.

6. The image forming apparatus according to claim 1, wherein the frame contains the member for forming an image on a recording material, wherein the planar portion is a portion of a side surface of the frame.

7. The image forming apparatus according to claim 1, wherein the exterior member is mounted on the frame.

8. The image forming apparatus according to claim 1, wherein the planar portion of the frame is a part of a metal plate.

9. The image forming apparatus according to claim 1, wherein a thickness of the sheet member is 0.05 mm to 0.5 mm.

* * * * *